United States Patent [19]

Luszczycki

[11] Patent Number: 4,905,790

[45] Date of Patent: Mar. 6, 1990

[54] SUPPRESSOR OF GAS PRESSURE FLUCTUATION AND NOISE

[75] Inventor: Marian Luszczycki, Kraków, Poland

[73] Assignee: Zaklady Budowy Maszyn I Apparatury, Krakow, Poland

[21] Appl. No.: 277,280

[22] Filed: Nov. 29, 1988

[51] Int. Cl.[4] ..... F01N 1/08

[52] U.S. Cl. ..... 181/272; 181/229; 181/240; 181/256; 181/403

[58] Field of Search ..... 181/229, 272, 240, 403, 181/256

[56] References Cited

U.S. PATENT DOCUMENTS 4,284,162 8/1981 Fshida ..... 181/272 X
4,330,239 5/1982 Gannaway ..... 181/272 X

FOREIGN PATENT DOCUMENTS 815128 9/1951 Fed. Rep. of Germany .
514944 3/1921 France .
118094 6/1983 Poland .
131072 11/1985 Poland .
766723 1/1957 United Kingdom .

*Primary Examiner*—B. R. Fuller
*Attorney, Agent, or Firm*—Ladas & Parry

[57] ABSTRACT

The invention provides a pressure-fluctuation and noise suppressor having low flow resistance and high effectiveness. It is especially useful as a suppressor for an oil-injection inlet system of a positive-displacement air compressor. It has a cylinderical housing separated into ante- and main chambers by a partition. A tubular suppressing element is fixed through the partition eccentrically of the axis of the housing. The inlet of the suppressing element is in the form of a nozzle in the ante-chamber that widens away from the partition. In the main chamber, the wall of the suppressing element is perforated and the end of the suppressing element in the main chamber is closed by a conical member. An outlet tube is situated on a side wall of the housing in a plane perpendicular to the axis of the housing on an axis transecting the axes of the chambers and the suppressing element. An inlet extends into the ante-chamber diagonally from the nozzle of the suppressing element.

8 Claims, 1 Drawing Sheet

SUPPRESSOR OF GAS PRESSURE FLUCTUATION AND NOISE

BACKGROUND OF THE INVENTION

The subject of the invention is a suppressor of gas pressure fluctuation and noise for inlet and outlet systems of machines operating in cycles with a working medium is gas, and especially for an inlet oil injection inlet system of a positive displacement air compressor.

Cyclic operation of positive-displacement machines generates pressure fluctuations which, particularly in an inlet system, may cause a considerable decrease of the volumetric efficiency of the machine and an increased power demand for compression. Besides, the inlet system emits noise, mainly of aerodynamic origin, of a relatively high sound intensity level. Disadvantageous effects of those phenomena are minimized by application of various types of suppressors to the inlet and outlet systems of such machines.

For example the type of system for suppressing pressure fluctuation and noise of compressors presented in Polish patent specification No. 118 094 comprises a suppressor in a cylindrical housing which contains a chamber with an eccentrically fixed tubular suppressing element. The outlet tube is situated on the side surface, in the plane perpendicular to the axis of the suppressor, dividing the chamber into two equal parts, and oriented according to the axis transecting the axes of the chamber and the suppressing element. Air flows into the suppressor through the tubular suppressing element, wherefrom it gets out through a longitudinal slot situated on the wall of the element, most closely to the housing of the suppressor. Eccentric location of the suppressing element forms in the space of the chamber a system of two symmetrical nozzles through which air flows to the outlet tube. Owing to such design, pressure fluctuation and noise are advantageously suppressed, but hydraulic resistance, patricularly at high flow velocities, significantly affect the filling efficiency, capacity and power demand for compression.

Some positive-displacement machines, especially compressors with oil injection at the inlet, for example according to Polish patent application No. P-212 219, are characterized, for the reason of a very short piston stroke in relation to the lateral dimension, by a strong dependence on flow resistance at the inlet. In such conditions, when we strive at dynamically supercharging the compressor, which, entails an unfortunate increase of the intensity level of aerodynamic-origin noise emitted to the environment, designing of a pressure-fluctuation and noise suppressor which also provides for low flow resistance is a particularly significant technical problem.

SUMMARY OF THE INVENTION

The suppressor according to the invention comprises, apart from the presented solution of the chamber with an eccentric suppressing element, an ante-chamber separated in the cylindrical housing by a lateral partition through which the inlet of a tubular suppressing element passes. The inlet of the suppressing element is in the form of a nozzle widening towards the ante-chamber. The wall of the tubular suppressing element is perforated and its end is closed with a conical member. The inlet tube of the suppressor, most preferably in the form of a diffuser, passes through the bottom into the ante-chamber, eccentrically and on the opposite side of the nozzle of the suppressing element. Circumferentially uniform flow of gas is provided for by the perforated wall of the suppressing element, perforation holes being of various diameters, symmetrically in relation to the plane determined by axes of the outlet tube and the suppressing element.

In such a solution superposition of the effects resulting from perforation of the wall of the eccentric suppressing element, optimization of air flow conditions by means of the diffuser and the inlet nozzle, reflectionless termination of the element with a conical member, and circumferential outflow of gas through the wall perforated all over its surface—all this gives a combination of characteristics resulting not only in reduction of flow resistance but also in an increased suppression effect. Suppression efficiency results here basically from direct and dynamic interaction of pressure fluctuation and noise waves perpendicular to each other.

BRIEF DESCRIPTION OF THE DRAWING

The subject of the invention is presented in an example of its realisation in the enclosed drawing, in which.

DESCRIPTION OF THE DRAWN EXAMPLE

Figure 1:
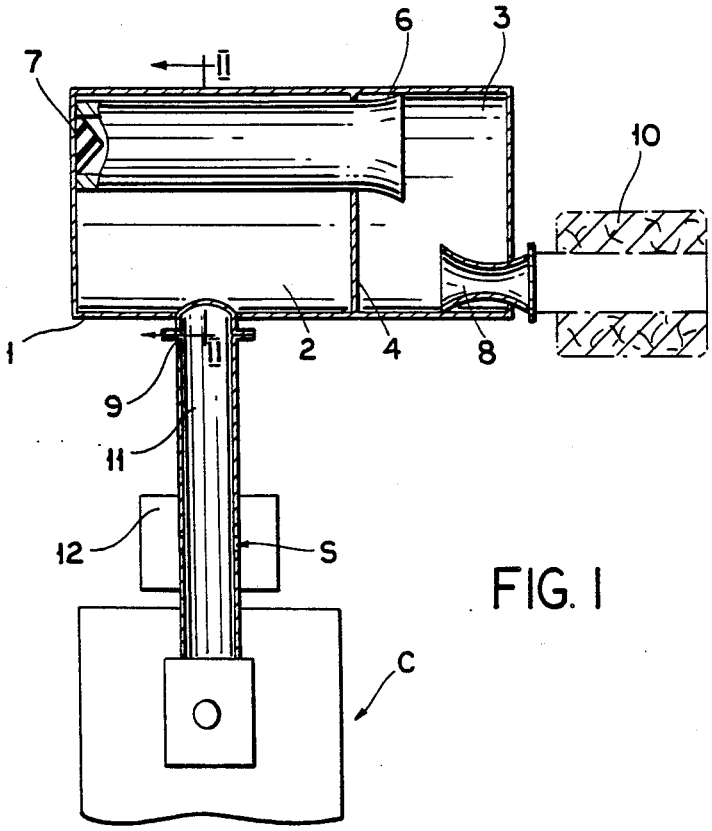
FIG. 1 shows diagramatically the axial section of the suppressor, together with elements of an exemplary oil-injection inlet system of a positive-displacement air compressor.

In a cylindrical housing 1 of the suppressor is a lateral, i.e. axis perpendicular partition 4, which separates two chambers, an ante-chamber at 3 and a main chamber at 2, and an eccentrically fixed tubular suppressing element 5. The inlet of the tubular suppressing element 5, which passes through the lateral partition 4, is in the ante-chamber 3 in the form of a nozzle 6 widening into the ante-chamber 3 from the partition 4. The remainder of suppressing element 5 is in the main chamber 2, has a perforated axial wall and is closed at its end most remote from the partition 4 by means of a coaxial conical member 7 with its apex extending toward the ante-chamber 3.

Figure 2:
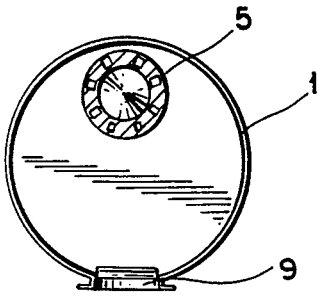
FIG. 2 shows the cross-section along line marked II—II in FIG. 1.

The perforation of the wall of the suppressing element 5 is such that it provides for constant air flow therethrough about the whole perimeter thereof, in spite of unilateral flow throttling owing to the wall of the housing 1 being nearer some portions of the parimeter than others as a necessary result of the eccentric fixation of the suppressing element 5. FIG. 2 shows differentiation of diameters of perforation holes for this; in the zone where the suppressing element 5 approaches the housing 1 the diameter of the holes is bigger than that of the holes on the opposite side. Besides, there is angular displacement (not shown) between axially neighbouring cross-sections of the suppressing element 5.

An inlet tube 8 is adapted for co-operation with a dry paper filter 10 outside the housing 1, as used in internal-combustion engines of motorization. The inlet tube 8 extends into the bottom of the ante-chamber 3, is in the form of a diffuser and is situated differently eccentrically and on the opposite side of the ante-chamber from the nozzle 6 of the suppressing element 5.

An outlet tube 9 of the suppressor extends from the side surface of the housing 1, has an axis in the plane perpendicular to the axis of the suppressor and axially dividing the main chamber 2 into two preferably substantially equal parts. Its axis transects the axes of the main chamber 2 and the suppressing element 5. It is on the opposite side of the main chamber 2 from the suppressing element 5.

The outlet tube 9, in the example being described, is connected through rectilinear inlet piping 11 with a positive-displacement compressor at C provided at the outlet with a nozzle (not shown) through which oil is injected into the inlet channel, inside a spinning camshaft (not shown). Dynamic supercharging of the compressor by resonance in the inlet piping 11 is achieved by at least one resonant cavity 12 communicating with the inlet piping 11 via an annular hole or slot at S in the latter.

The suppressor of the described design assures advantageous wave courses and, at the same time, makes it possible to suppress an increase of the intensity level of sound emitted to the environment from the supercharging. Advantageous effects are noticeable in capacity of the compressor and its power demand for compression.

What is claimed is:

1. A gas pressure-fluctuation and noise suppressor, comprising:

a cylindrical housing (1);

a partition (4) in the housing (1) separating the housing (1) into an ante-chamber (3) and a main chamber (2), the partition (4) being perpendicular to an axis of the housing (1);

a tubular suppressing element (5) fixed through the partition (4) eccentrically of the axis of the housing (1), a nozzle (6) of the suppressing element (5) widening into the ante-chamber (3) from the partition (4) and a remainder of the suppressing element (5) being in the main chamber (2) and having a perforated axial wall, an end of the suppressing element (5) in the main chamber (2) and most remote from the partition (4) being closed by a conical member (7) coaxial with the suppressing element (5) and having an apex extending toward the ante-chamber (3);

an inlet tube (8) opening into the ante-chamber (3) from outside the housing (1) eccentrically of the axis of the housing (1) at a position different from the suppressing element (5) and on an opposite side of the ante-chamber (3) from the partition (4); and an outlet tube (9) extending from the main chamber (2) with an axis in a plane perpendicular to the axis of the housing (1) and transversing the axis of the housing (1) and an axis of said suppressing element (5).

2. The gas pressure-fluctuation and noise suppressor of claim 1, wherein a plane of the axis of the outlet ttube (9) axially divides the main chamber (2) into two substantially equal parts.

3. The gas pressure-fluctuation and noise suppressor of claim 1, wherein the inlet tube (8) opening into the ante-chamber (3) defines a diffuser.

4. The gas pressure-fluctuation and noise suppressor of claim 2, wherein the inlet tube (8) opening into the ante-chamber (3) defines a diffuser.

5. The gas pressure-fluctuation and noise suppressor of claim 1, wherein the perforated axial wall of the suppressing element (5) comprises means for providing constant gas flow thereabout.

6. The gas pressure-fluctuation and noise suppressor of claim 2, wherein the perforated axial wall of the suppressing element (5) comprises means for providing constant gas flow thereabout.

7. The gas pressure-fluctuation and noise suppressor of claim 3, wherein the perforated axial wall of the suppressing element (5) comprises means for providing constant gas flow thereabout.

8. The gas pressure-fluctuation and noise suppressor of claim 4, wherein the perforated axial wall of the suppressing element (5) comprises means for providing constant gas flow thereabout.

* * * * *